US005445498A

United States Patent [19]

Williams et al.

[11] Patent Number: 5,445,498

[45] Date of Patent: Aug. 29, 1995

[54] BUCKET FOR NEXT-TO-THE-LAST STAGE OF A TURBINE

[75] Inventors: John C. Williams, Schenectady; Stephen G. Ruggles, Scotia, both of N.Y.

[73] Assignee: General Electric Company, Schenectady, N.Y.

[21] Appl. No.: 258,042

[22] Filed: Jun. 10, 1994

[51] Int. Cl.[6] ..... F01D 5/14

[52] U.S. Cl. ..... 416/191; 416/193 R; 416/223 A

[58] Field of Search ..... 416/190, 191, 193 R, 416/223 A, DIG. 2

[56] References Cited

U.S. PATENT DOCUMENTS 5,267,834 12/1993 Dinh et al. ..... 416/223 A
5,286,169 2/1994 Dinh et al. ..... 416/223 A
5,299,915 4/1994 Dinh et al. ..... 416/223 A
5,326,221 7/1994 Amyot et al. ..... 416/223 A

*Primary Examiner*—Edward K. Look
*Assistant Examiner*—James A. Larson
*Attorney, Agent, or Firm*—Nixon & Vanderhye

[57] ABSTRACT

A next-to-the-last stage steam turbine bucket has a profile according to the table set forth in the specification. The buckets also include continuous couplings at the bucket mid-point including nubs on each bucket projecting from opposite sides thereof in generally circumferentially extending directions. A sleeve is disposed between each pair of adjacent buckets and has open opposite ends for receiving the nubs of the adjacent buckets. The cross-sections of the nubs and open ends of the sleeve are generally complementary and non-circular to prevent sleeve rotation during turbine operation. The buckets have a continuous cover including cover elements having tenons projecting from opposite sides for reception in corresponding openings in the tips of adjacent buckets.

9 Claims, 4 Drawing Sheets

BUCKET FOR NEXT-TO-THE-LAST STAGE OF A TURBINE

TECHNICAL FIELD

The present invention relates to turbines, for example, steam turbines, and particularly relates to next-to-last stage turbine buckets having improved aerodynamic and mechanical properties.

BACKGROUND

Next-to-last stage buckets for turbines are typically connected to one another in groups with cover or shroud bands at the tip and a loose tie wire at about the mid-point of the buckets. Unfortunately, under certain conditions, grouped bucket designs such as these can be stimulated by dynamic steam forces and vibrate at the natural frequencies of the grouped buckets and cover assembly. If the vibration is sufficiently large, fatigue damage to the bucket material can occur and lead to crack initiation and eventual bucket failure. Further, the loose tie wire connection requires a hole or opening in each bucket which can lead to high centrifugal stresses at the hole and greater susceptibility to stress corrosion or fatigue cracking at the hole.

The grouped bucket design also results in gaps between the ends of adjacent bucket cover groups. These gaps permit steam leakage at the tip between cover groups and can reduce the thermodynamic efficiency of the next-to-the-last stage.

DISCLOSURE OF THE INVENTION

In accordance with the present invention, there is provided a new and improved next-to-the-last stage bucket for turbines, particularly steam turbines, for use in new turbines as well as replacement buckets for operating turbines. The present invention incorporates improved aerodynamic design manifested in a particular bucket profile and continuous coupling of the buckets at their tips and near the mid-point of the buckets' active length to reduce vibratory response and improve mechanical reliability. The buckets are connected at the tip with side entry covers having a single radially outward-extending sealing rib on the surface of each bucket tip and cover to reduce steam leakage over the tip and improve stage thermodynamic efficiency. Instead of loose tie wires through holes in the buckets adjacent their mid-points, continuous loose sleeve connections are provided. This eliminates any need for tie wire holes. The bucket also is overtwisted to compensate for the untwist due to centrifugal force to improve thermodynamic efficiency.

Accordingly, it is a primary object of the present invention to provide a novel and improved bucket for the next-to-the-last stage of a turbine, particularly a steam turbine, and provide a novel and improved bucket which has improved aerodynamic design, lower centrifugal stresses, reduced vibratory response and, hence, improved reliability and continuous tip sealing to improve thermodynamic performance.

BEST MODE FOR CARRYING OUT THE INVENTION

Figure 1:
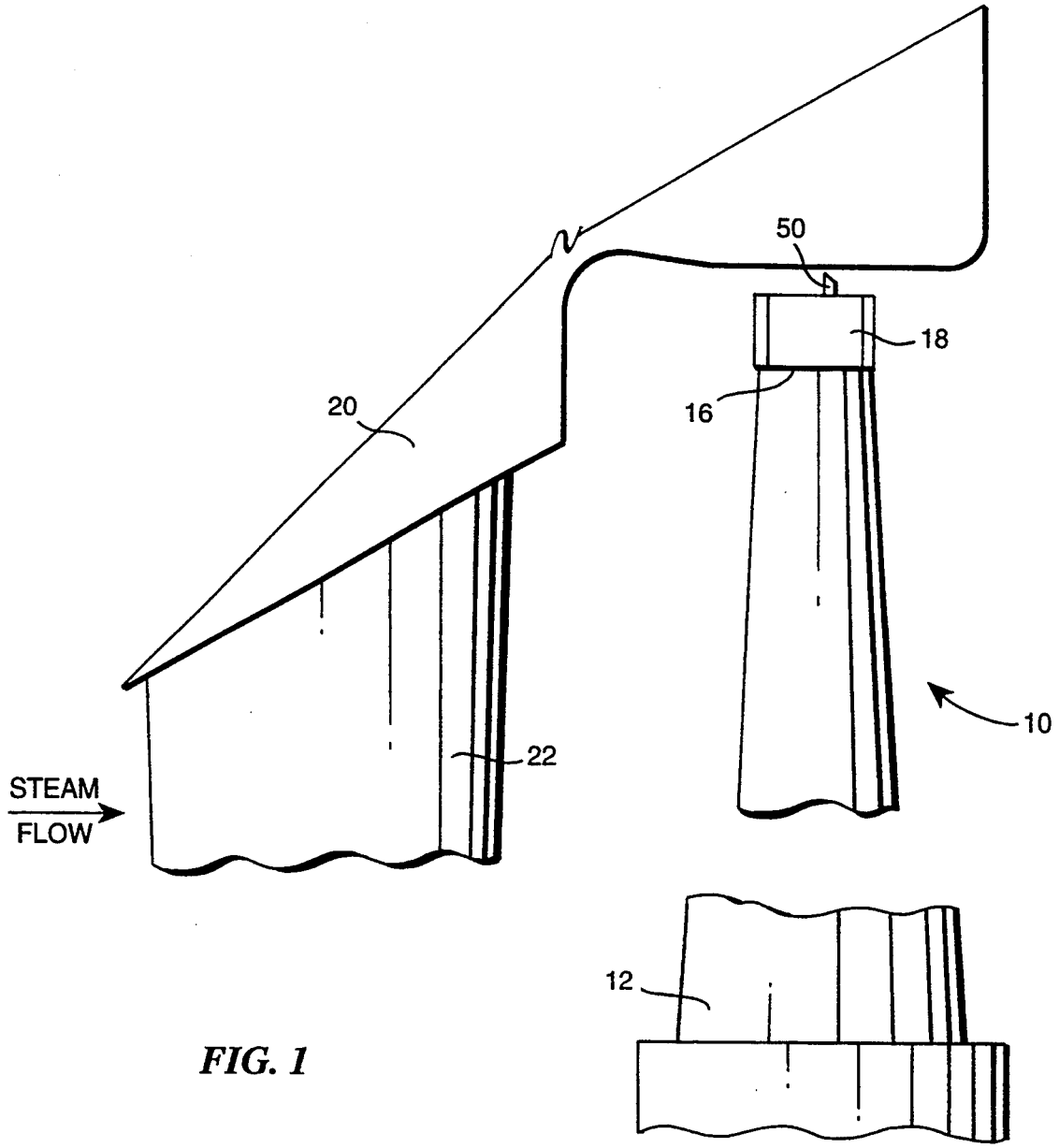
FIG. 1 is a schematic illustration of a bucket tip and cover assembly for tip leakage control in accordance with the present invention.
Figure 5:
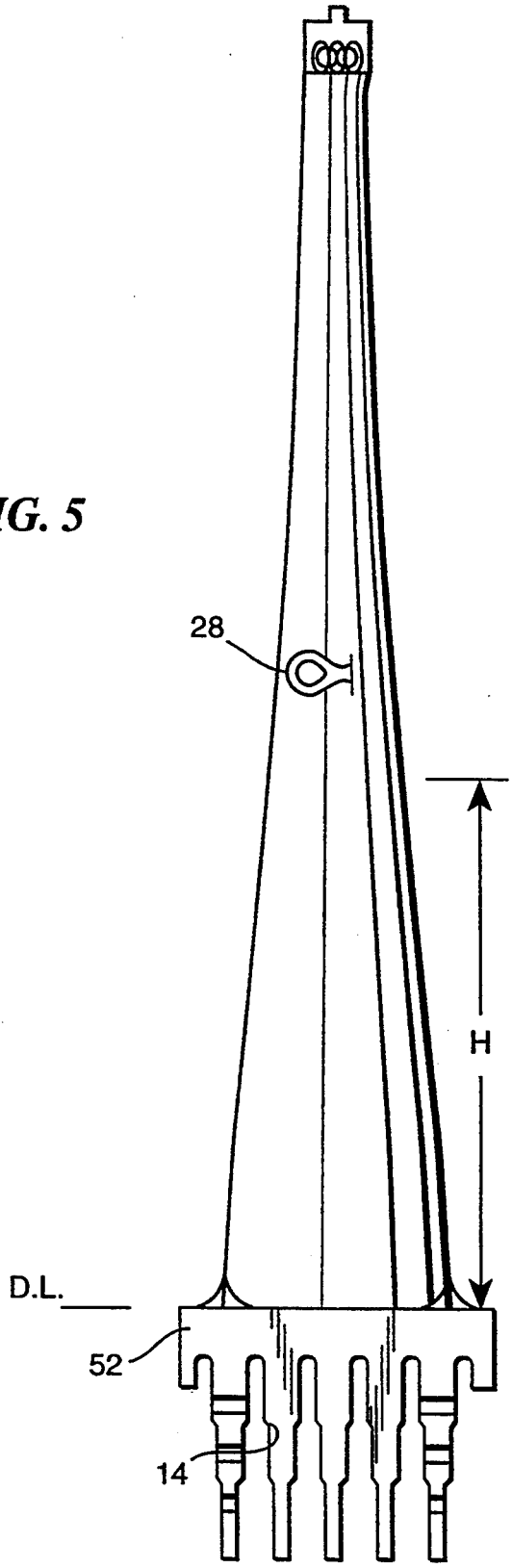
FIG. 5 is a tangential view of a next-to-the-last stage bucket constructed in accordance with the present invention and illustrating its aerodynamic profile.

Referring now to the drawings, particularly to FIG. 1, there is illustrated a bucket according to the present invention, generally designated 10, having a root section 12 connected to a finger dovetail section 14 (FIG. 5), and, in turn, for connection to a rotor wheel W (FIG. 2) of the turbine. Bucket 10 also includes a tip 16, to which covers 18 are secured as described hereinafter. Portions of the turbine housing 20 are illustrated in FIG. 1, as well as the nozzle 22 preceding the next-to-the-last stage turbine bucket rotor wheel W.

Figure 2:
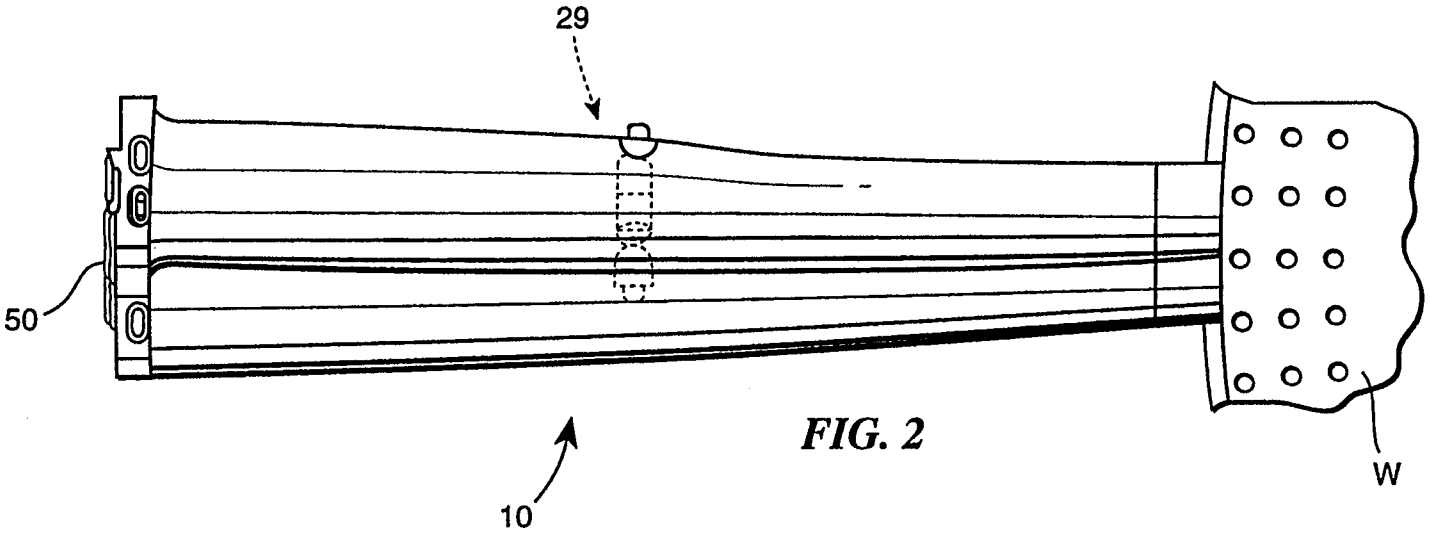
FIG. 2 is a fragmentary elevational view of a pair of buckets constructed in accordance with the present invention.
Figure 3:
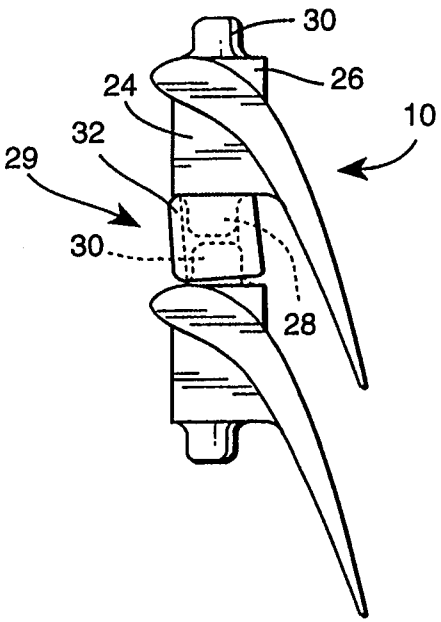
FIG. 3 is a plan view of the buckets with the end covers removed to illustrate the continuous loose sleeve connection at the mid-portion of adjacent buckets.

Referring now to FIGS. 2 and 3, the buckets 10 are continuously coupled at an intermediate location, preferably a mid-point, along the buckets by a loose sleeve connection, generally designated 29. To provide such continuous loose connection without forming an opening or a hole through the mid-portion of the bucket, there is provided projections 24 and 26 on opposite sides of the buckets 10 and which projections are integral with the buckets. Each projection includes a projecting integral nub 28 and 30, respectively. Each nub 28 and 30 is in a non-circular cross-sectional shape, for example, as shown by nub 28 in FIG. 5. To couple the adjacent buckets 10 to one another, sleeves 32 open at opposite ends and receive the aligned projecting nubs 28 and 30 of the adjacent buckets 10. The ends of the sleeve lie in a plane at an angle other than 90° to the axis of the sleeve to enable the sleeves to rock as the relative position of the adjacent nubs change with untwist of the buckets due to centrifugal force. The non-circular cross-sectional shape of the nubs 28 and 30 when received in the sleeves 32 and wherein the sleeves 32 have essentially a complementary-shaped interior cross-section, prevent the sleeves from rotating during turbine operation. A similar type of mid-bucket coupling is described and illustrated in U.S. Pat. No. 5,267,834, issued Dec. 7, 1993, of common assignee herewith.

Figure 4:
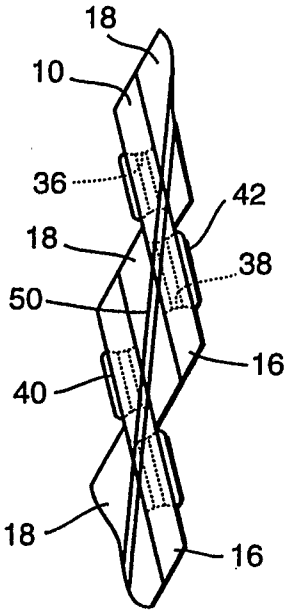
FIG. 4 is a fragmentary end elevational view of the end covers for adjacent buckets.

Referring now to FIGS. 2 and 4, the tips 16 of the buckets 10 are continuously coupled with side entry covers 18 to provide rigid tip restraint, structural coupling and damping to minimize bucket vibration. The side entry covers 18 comprise individual covers connecting adjacent buckets. Each of the tips 16 of the buckets have a pair of openings 36 and 38. Each bucket cover 18 consists of a parallelogram-shaped piece having parallel sides with a tenon 40 which projects upstream to the admissions side of the bucket. The opposite side of the cover includes a tenon 42 which projects downstream to the discharge side of the bucket. The tenon 40 on the bucket admission side is received in an opening in the tip 16 of the blade and peened over to provide a rigid connection. The tenon 42, however, on the discharge side has a hole in its end which permits the tenon to be flared and results in a loose connection with the tip of the bucket. It will be appreciated, however, from a review of FIG. 4, that the covers extend continuously about the entire circumference of the bucket tips to form a continuous closed cover about the turbine bucket tips. A similar type of cover is also disclosed in the aforementioned U.S. Pat. No. 5,267,834.

It will be appreciated that the dovetails 14 are received in dovetail grooves in the wheel W whereby the buckets are secured to the turbine wheel. Additionally, the shape of the bucket is twisted to reduce local stresses due to centrifugal forces and untwist during operation. That is, the bucket has been overtwisted to compensate for vane untwist due to centrifugal force to improve thermodynamic efficiency. Note also that a sealing rib 50 (FIG. 1) extends radially outwardly of the surface of each bucket tip 16 and cover 18. The rib 50 reduces steam leakage over the tip and improves stage thermodynamic efficiency.

Figure 6:
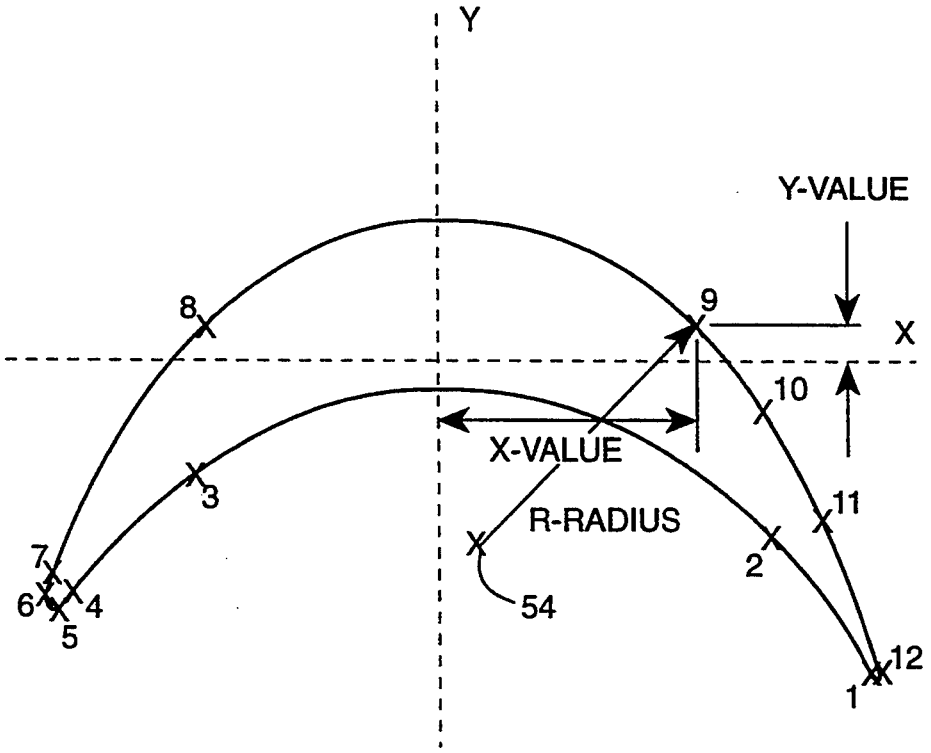
FIG. 6 is a graph illustrating a representative air foil section of the bucket profile as defined by charts set forth in the following specification.

Referring now to FIG. 6, there is illustrated a representative bucket section profile at a predetermined distance H (a representative height H being illustrated in FIG. 5) from a datum line D.L. at the intersection of the bucket root and the bucket base 52. Each profile section at that radial distance is defined in X-Y coordinates by adjacent points identified by representative numerals, for example, the illustrated numerals 1 through 12 and which adjacent points are connected one to the other along the arcs of circles having radii R. For example, the arc connecting points 9 and 10 constitutes a portion of a circle having a radius R at a center 54. Values of the X-Y coordinates and the radii R for each bucket section profile taken at specific radial locations or heights H from the datum line D.L. are tabulated in the following Table I, including charts identified as Sections 1 through 15. The charts identify the various points along a profile section at the given radial distance H from the datum line D.L. by their X-Y coordinates and it will be seen that the charts have anywhere from 10 to 24 representative X-Y coordinate points, depending upon the profile section height from the datum line. These values are given in inches and represent actual bucket configurations at ambient non-operating conditions. The value for each radius R provides the length of the radius defining the arc of the circle between two of the adjacent points identified by the X-Y coordinates. The sign convention assigns a positive value to the radius R when the adjacent two points are connected in a clockwise direction and a negative value to the radius R when the two adjacent points are connected in a counterclockwise direction. By providing X-Y coordinates for spaced points about the blade profile at selected radial positions or heights H from the datum line D.L. and defining the radii R of circles connecting adjacent points, the profile of the bucket is defined at each radial position and thus the bucket profile is defined throughout its entire length. The chart titled Section 1 of Table I represents the theoretical profile of the bucket at the datum line D.L. The actual profile at that location includes the fillets in the section of the bucket connecting the air foil and the dovetail sections, the fillets fairing the profile bucket into the structural base of the bucket.

TABLE I

VANE SECTION COORDINATE DESCRIPTIONS

| POINT NUMBER | X | Y | R |
|---|---|---|---|
| SECTION NO. 1 | | | |
| RADIAL DISTANCE FROM DATUM 0.000 | | | |
| 1 | 1.78447 | −1.26580 | −3.92857 |
| 2 | 1.37721 | −0.71349 | −1.85000 |
| 3 | −1.13559 | −0.46896 | −3.60911 |
| 4 | −1.68789 | −0.99355 | 0.85000 |
| 5 | −1.74095 | −1.05038 | 0.04000 |
| 6 | −1.80764 | −1.01179 | 0.85000 |
| 7 | −1.77276 | −0.90582 | 3.67891 |
| 8 | −1.08881 | 0.18593 | 1.47000 |
| 9 | 1.07542 | 0.20273 | 2.31289 |
| 10 | 1.35284 | −0.16051 | 3.03160 |
| 11 | 1.58654 | −0.62329 | 10.95865 |
| 12 | 1.81670 | −1.25084 | 0.01788 |
| 13 | 1.78447 | −1.26580 | |
| SECTION NO. 2 | | | |
| RADIAL DISTANCE FROM DATUM 1.500 | | | |
| 1 | 1.70199 | −1.36919 | −4.86292 |
| 2 | 1.24789 | −0.71662 | −1.73536 |
| 3 | −1.09578 | −0.40625 | −3.44758 |
| 4 | −1.56611 | −0.80852 | 0.85000 |
| 5 | −1.65876 | −0.89055 | 0.04800 |
| 6 | −1.73275 | −0.83533 | 0.85000 |
| 7 | −1.70444 | −0.76937 | 4.48660 |
| 8 | −1.08685 | 0.18439 | 1.35000 |
| 9 | 0.98397 | 0.17419 | 3.18686 |
| 10 | 1.48299 | −0.66119 | 10.02953 |
| 11 | 1.73486 | −1.35457 | 0.01809 |
| 12 | 1.70199 | −1.36919 | |
| SECTION NO. 3 | | | |
| RADIAL DISTANCE FROM DATUM 3.000 | | | |
| 1 | 1.59095 | −1.47080 | −5.30799 |
| 2 | 1.10052 | −0.70932 | −1.65000 |
| 3 | −1.05018 | −0.30050 | −4.08306 |
| 4 | −1.45582 | −0.57661 | 0.85000 |
| 5 | −1.51850 | −0.62066 | 0.05850 |
| 6 | −1.60491 | −0.55130 | 0.85000 |
| 7 | −1.55072 | −0.43210 | 3.26645 |
| 8 | −1.08157 | 0.21601 | 1.30000 |
| 9 | 0.86806 | 0.16372 | 2.04153 |
| 10 | 1.03531 | −0.06773 | 4.08306 |
| 11 | 1.32548 | −0.62715 | 6.12460 |
| 12 | 1.42771 | −0.88408 | 12.24920 |
| 13 | 1.62470 | −1.45666 | 0.01837 |
| 14 | 1.59095 | −1.47080 | |
| SECTION NO. 4 | | | |
| RADIAL DISTANCE FROM DATUM 4.500 | | | |
| 1 | 1.46836 | −1.54983 | −7.52193 |
| 2 | 1.03424 | −0.80523 | −2.89525 |
| 3 | 0.94458 | −0.67754 | −1.65000 |
| 4 | −0.93172 | −0.10672 | −3.70000 |
| 5 | −1.33873 | −0.27921 | 0.54996 |
| 6 | −1.37754 | −0.29662 | 0.06494 |
| 7 | −1.46116 | −0.21002 | 0.52910 |
| 8 | −1.40788 | −0.11693 | 2.84665 |
| 9 | −1.03464 | 0.30786 | 1.20000 |
| 10 | 0.59033 | 0.31863 | 1.53150 |
| 11 | 0.81042 | 0.07024 | 2.71178 |
| 12 | 1.05241 | −0.34487 | 7.14461 |
| 13 | 1.32913 | −1.02217 | 23.57174 |
| 14 | 1.50228 | −1.53581 | 0.01841 |
| 15 | 1.46836 | −1.54983 | |
| SECTION NO. 5 | | | |
| RADIAL DISTANCE FROM DATUM 6.000 | | | |
| 1 | 1.34294 | −1.62054 | −12.38616 |
| 2 | 0.94641 | −0.88968 | −2.89011 |
| 3 | 0.63594 | −0.45741 | −1.59357 |
| 4 | −0.82024 | 0.07109 | −2.89011 |
| 5 | −1.23823 | −0.02846 | 0.26837 |
| 6 | −1.29548 | −0.04002 | 0.05367 |
| 7 | −1.35233 | 0.02661 | 0.26837 |
| 8 | −1.29613 | 0.13512 | 1.85793 |
| 9 | −0.93179 | 0.46193 | 1.10000 |
| 10 | 0.54598 | 0.24239 | 2.89011 |
| 11 | 0.95836 | −0.45051 | 10.32180 |
| 12 | 1.21272 | −1.12201 | 0. |
| 13 | 1.37714 | −1.60626 | 0.01857 |

TABLE I-continued

VANE SECTION COORDINATE DESCRIPTIONS

| POINT NUMBER | X | Y | R |
|---|---|---|---|
| 14 | 1.34294 | −1.62054 | |
| SECTION NO. 6 | | | |
| RADIAL DISTANCE FROM DATUM 7.500 | | | |
| 1 | 1.20935 | −1.67171 | −12.71423 |
| 2 | 0.81784 | −0.90728 | −3.88267 |
| 3 | 0.37276 | −0.26730 | −1.45000 |
| 4 | −0.48323 | 0.21859 | −2.38855 |
| 5 | −1.05880 | 0.24686 | 0.39074 |
| 6 | −1.14916 | 0.25085 | 0.06152 |
| 7 | −1.19562 | 0.33647 | 0.30764 |
| 8 | −1.11511 | 0.44505 | 1.35461 |
| 9 | −0.85643 | 0.62039 | 0.95000 |
| 10 | 0.24530 | 0.45822 | 2.00000 |
| 11 | 0.49239 | 0.16644 | 3.00000 |
| 12 | 0.83685 | −0.49039 | 23.70320 |
| 13 | 1.13248 | −1.32508 | 0. |
| 14 | 1.24346 | −1.65807 | 0.01840 |
| 15 | 1.20935 | −1.67171 | |
| SECTION NO. 7 | | | |
| RADIAL DISTANCE FROM DATUM 8.999 | | | |
| 1 | 1.07984 | −1.70073 | −11.67688 |
| 2 | 0.67372 | −0.86186 | −7.92699 |
| 3 | 0.27941 | −0.20293 | −2.21998 |
| 4 | 0.13869 | −0.01421 | −1.05609 |
| 5 | 0.02557 | 0.10227 | −1.07487 |
| 6 | −0.14633 | 0.22614 | −1.51841 |
| 7 | −0.37390 | 0.33401 | −2.22949 |
| 8 | −0.69155 | 0.42718 | −3.17886 |
| 9 | −0.96733 | 0.47367 | 0.49077 |
| 10 | −0.98381 | 0.47599 | 0.09373 |
| 11 | −1.03444 | 0.63583 | 0.49077 |
| 12 | −0.96291 | 0.69322 | 1.01709 |
| 13 | −0.86149 | 0.75218 | 0.78634 |
| 14 | −0.64240 | 0.82491 | 0.85253 |
| 15 | −0.40190 | 0.83251 | 0.71409 |
| 16 | −0.18936 | 0.77487 | 1.03167 |
| 17 | 0.07821 | 0.60158 | 1.43162 |
| 18 | 0.32282 | 0.31664 | 2.96152 |
| 19 | 0.55030 | −0.10247 | 7.46617 |
| 20 | 0.82124 | −0.80951 | −32.93732 |
| 21 | 0.86633 | −0.94677 | 0. |
| 22 | 0.99087 | −1.32207 | 0. |
| 23 | 1.11393 | −1.68759 | 0.01829 |
| 24 | 1.07984 | −1.70073 | |
| SECTION NO. 8 | | | |
| RADIAL DISTANCE FROM DATUM 10.499 | | | |
| 1 | 0.96505 | −1.71272 | −13.53744 |
| 2 | 0.29872 | −0.30065 | −8.15240 |
| 3 | 0.21421 | −0.14930 | −1.55343 |
| 4 | −0.20953 | 0.32743 | −2.72577 |
| 5 | −0.77204 | 0.64825 | 0.36823 |
| 6 | −0.89983 | 0.73813 | 0.07420 |
| 7 | −0.88977 | 0.84774 | 0.36976 |
| 8 | −0.71956 | 0.91811 | 0.87530 |
| 9 | 0.07530 | 0.61181 | 1.62344 |
| 10 | 0.27165 | 0.31538 | 5.19959 |
| 11 | 0.54445 | −0.31334 | 13.26790 |
| 12 | 0.67686 | −0.70253 | 0. |
| 13 | 0.99917 | −1.70035 | 0.01816 |
| 14 | 0.96505 | −1.71272 | |
| SECTION NO 9 | | | |
| RADIAL DISTANCE FROM DATUM 11.999 | | | |
| 1 | 0.86781 | −1.72141 | −20.31960 |
| 2 | 0.55963 | −0.94949 | −13.28948 |
| 3 | 0.28211 | −0.33728 | −3.37197 |
| 4 | 0.05294 | 0.06353 | −2.49469 |
| 5 | −0.19291 | 0.37540 | −3.10902 |
| 6 | −0.48662 | 0.65367 | −4.84913 |
| 7 | −0.66240 | 0.79297 | 0.52090 |
| 8 | −0.75100 | 0.87807 | 0.09948 |
| 9 | −0.67847 | 1.04058 | 0.52090 |
| 10 | −0.47003 | 1.00686 | 1.65807 |
| 11 | −0.31357 | 0.93789 | 0.93095 |
| 12 | −0.06450 | 0.75463 | 1.20329 |
| 13 | 0.10809 | 0.52805 | 3.20470 |
| 14 | 0.31435 | 0.11150 | 4.59350 |
| 15 | 0.41090 | −0.14729 | 22.57370 |

TABLE I-continued

VANE SECTION COORDINATE DESCRIPTIONS

| POINT NUMBER | X | Y | R |
|---|---|---|---|
| 16 | 0.59971 | −0.72977 | 0. |
| 17 | 0.90197 | −1.70974 | 0.01806 |
| 18 | 0.86781 | −1.72141 | |
| SECTION NO. 10 | | | |
| RADIAL DISTANCE FROM DATUM 13.501 | | | |
| 1 | 0.79368 | −1.72303 | −25.49671 |
| 2 | 0.33539 | −0.51451 | −11.02362 |
| 3 | 0.29859 | −0.42555 | −3.21078 |
| 4 | 0.13557 | −0.09184 | −5.51095 |
| 5 | −0.61623 | 0.94242 | 0.23100 |
| 6 | −0.67195 | 1.04914 | 0.06271 |
| 7 | −0.61692 | 1.12507 | 0.22800 |
| 8 | −0.51909 | 1.11340 | 0.94185 |
| 9 | −0.10695 | 0.82778 | 1.83191 |
| 10 | 0.14032 | 0.44192 | 3.96402 |
| 11 | 0.25993 | 0.16395 | 6.32042 |
| 12 | 0.43416 | −0.35323 | 0. |
| 13 | 0.82754 | −1.71221 | 0.01778 |
| 14 | 0.79368 | −1.72303 | |
| SECTION NO. 11 | | | |
| RADIAL DISTANCE FROM DATUM 15.001 | | | |
| 1 | 0.74325 | −1.72355 | −19.62688 |
| 2 | 0.28383 | −0.46661 | −5.74502 |
| 3 | −0.15002 | 0.39114 | −14.29570 |
| 4 | −0.52496 | 0.96830 | 0.38800 |
| 5 | −0.58609 | 1.11574 | 0.06475 |
| 6 | −0.50304 | 1.18948 | 0.35900 |
| 7 | −0.39363 | 1.13298 | 1.58511 |
| 8 | 0.01239 | 0.67755 | 2.29099 |
| 9 | 0.18184 | 0.32599 | 6.63668 |
| 10 | 0.37564 | −0.26469 | 0. |
| 11 | 0.77686 | −1.71340 | 0.01756 |
| 12 | 0.74325 | −1.72355 | |
| SECTION NO. 12 | | | |
| RADIAL DISTANCE FROM DATUM 16.501 | | | |
| 1 | 0.68283 | −1.72099 | −17.20274 |
| 2 | 0.26957 | −0.50368 | −9.52530 |
| 3 | −0.11590 | 0.37151 | −23.10623 |
| 4 | −0.31559 | 0.76024 | −31.11145 |
| 5 | −0.45903 | 1.02987 | 0.39216 |
| 6 | −0.50020 | 1.14921 | 0.07490 |
| 7 | −0.39227 | 1.22859 | 0.39216 |
| 8 | −0.26901 | 1.12977 | 2.28339 |
| 9 | 0.09409 | 0.51823 | 5.92811 |
| 10 | 0.24417 | 0.09678 | 10.27896 |
| 11 | 0.40454 | −0.47008 | 0. |
| 12 | 0.71629 | −1.71181 | 0.01735 |
| 13 | 0.68283 | −1.72099 | |
| SECTION NO. 13 | | | |
| RADIAL DISTANCE FROM DATUM 18.001 | | | |
| 1 | 0.64091 | −1.71118 | −17.28406 |
| 2 | 0.20404 | −0.38206 | −8.64203 |
| 3 | 0.00274 | 0.10935 | −27.28406 |
| 4 | −0.42166 | 1.01588 | 0.45200 |
| 5 | −0.46546 | 1.16829 | 0.07000 |
| 6 | −0.35881 | 1.23493 | 0.45200 |
| 7 | −0.23162 | 1.11616 | 2.43636 |
| 8 | −0.00574 | 0.73497 | 3.07272 |
| 9 | 0.11905 | 0.43177 | 8.64203 |
| 10 | 0.36790 | −0.41426 | 0. |
| 11 | 0.67621 | −1.70193 | 0.01825 |
| 12 | 0.64091 | −1.71118 | |
| SECTION NO. 14 | | | |
| RADIAL DISTANCE FROM DATUM 19.501 | | | |
| 1 | 0.59863 | −1.69873 | −19.27374 |
| 2 | 0.20716 | −0.46908 | −24.93439 |
| 3 | −0.32517 | 0.89876 | 27.14224 |
| 4 | −0.39138 | 1.05649 | 0.38605 |
| 5 | −0.42037 | 1.18282 | 0.07373 |
| 6 | −0.30595 | 1.24842 | 0.38605 |
| 7 | −0.19000 | 1.12784 | 1.63497 |
| 8 | −0.13435 | 1.02899 | 3.46094 |
| 9 | 0.05944 | 0.57983 | 7.42024 |
| 10 | 0.20472 | 0.11653 | 13.45749 |
| 11 | 0.36449 | −0.51753 | 0. |
| 12 | 0.38701 | −0.61699 | −38.67263 |
| 13 | 0.39245 | −0.64102 | 0. |

TABLE I-continued

| VANE SECTION COORDINATE DESCRIPTIONS | | | |
|---|---|---|---|
| POINT NUMBER | X | Y | R |
| 14 | 0.63139 | −1.69039 | 0.01691 |
| 15 | 0.59863 | −1.69873 | |
| SECTION NO. 15 | | | |
| RADIAL DISTANCE FROM DATUM 21.001 | | | |
| 1 | 0.55815 | −1.68003 | −33.94285 |
| 2 | −0.23160 | 0.72118 | 38.85700 |
| 3 | −0.34418 | 1.02886 | 0.38850 |
| 4 | −0.36503 | 1.20260 | 0.07000 |
| 5 | −0.24853 | 1.24703 | 0.38850 |
| 6 | −0.15947 | 1.12854 | 3.90285 |
| 7 | 0.08463 | 0.48930 | 18.85714 |
| 8 | 0.37931 | −0.69051 | 0. |
| 9 | 0.59104 | −1.67175 | 0.01697 |
| 10 | 0.55815 | −1.68003 | |

It will be appreciated that having defined the profile of the bucket at various selected heights from the root, properties of the bucket such as maximum and minimum moments of inertia, the area of the bucket at each section, the twist, torsional stiffness, shear centers and vane width can be ascertained.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket for a steam turbine having a profile in accordance with Table I inclusive as set forth in the specification.

2. A plurality of buckets, each constructed in accordance with claim 1, and spaced circumferentially about an axis of a turbine wheel, said buckets having tips, and covers continuously coupling said tips one to the other about said axis.

3. A plurality of buckets according to claim 2 wherein each said cover includes a first tenon projecting toward an admission side of the turbine wheel and a tenon projecting toward the discharge side of the turbine wheel, the tips of adjacent buckets having openings for receiving the tenons for coupling the tips one to the other.

4. A plurality of buckets according to claim 3 wherein each tenon on a bucket admission side is peened over to provide a rigid connection with an adjoining bucket tip and the tenon on a bucket discharge side has an opening in its end enabling the tenon to be flared, affording a loose connection between the cover and adjoining bucket.

5. A plurality of buckets according to claim 3 including a continuous sealing rib extending radially outwardly on the surface of each bucket tip and said cover.

6. A plurality of buckets, each constructed in accordance with claim 1, and spaced circumferentially about an axis of a turbine wheel, said buckets having intermediate portions, each intermediate portion of each bucket including a nub projecting in a generally circumferential direction toward an adjacent bucket, a sleeve open at opposite ends receiving the nubs of adjacent buckets affording a continuous coupling at the intermediate portions of the buckets.

7. A plurality of buckets according to claim 6 wherein each sleeve has an axis, the ends of the sleeves being formed at an angle to the axis other than 90° to permit the sleeves to rock as the relative positions of the adjacent nubs change during operation of the turbine.

8. A plurality of buckets according to claim 6 wherein each nub has a non-circular cross-section and the sleeve has a generally corresponding non-circular cross-section to preclude sleeve rotation during turbine operation.

9. A plurality of buckets according to claim 6 wherein the buckets have tips and means for continuously coupling said tips one to the other about the turbine axis.

* * * * *